United States Patent [19]

Bethlen

[11] 4,011,609

[45] Mar. 15, 1977

[54] HOSPITAL TROLLEYS

[75] Inventor: Farkas Bethlen, Richmond, England

[73] Assignee: G. D. Searle & Co., High Wycombe, England

[22] Filed: Oct. 6, 1975

[21] Appl. No.: 619,831

[30] Foreign Application Priority Data

Oct. 8, 1974 United Kingdom ..... 43567/74

[52] U.S. Cl. ..... 5/81 B

[51] Int. Cl.[2] ..... A47B 83/04; A61G 1/02

[58] Field of Search ..... 5/81 R, 86; 312/330, 312/335, 336; 297/248

[56] References Cited

UNITED STATES PATENTS

| | | | |
|---|---|---|---|
| 825,695 | 7/1906 | Beaudet | 312/335 |
| 2,103,885 | 12/1937 | Whalen | 312/336 |
| 3,316,018 | 4/1967 | Stith | 297/248 |

FOREIGN PATENTS OR APPLICATIONS

| | | | |
|---|---|---|---|
| 1,194,955 | 11/1959 | France | 5/81 B |
| 506,578 | 8/1930 | Germany | 5/81 B |

*Primary Examiner*—Casmir A. Nunberg
*Attorney, Agent, or Firm*—John J. Kolano; John A. Dhuey

[57] ABSTRACT

The present invention relates to a hospital trolley having a support member and framework with co-operating guide means to enable the transfer of a patient from one trolley to another. It also provides a means for securing two trolley frameworks together by means of interlocking plates.

9 Claims, 7 Drawing Figures

HOSPITAL TROLLEYS

The present invention relates to hospital trolleys and more particularly to trolleys which enable the transfer of a patient from one trolley to another or to and from another surface.

A trolley has previously been proposed which allows the transfer of a patient from one trolley to another without lifting the patient. Such transfer is desirable where a patient is transferred from a general purpose trolley to one used in a sterile area, for example an operating theatre, or from a general purpose trolley to a trolley with a specialized function, for example a resuscitation trolley.

In transferring the patient from a first trolley to a second trolley, it is preferable that the support on which the patient rests shall move smoothly from the first trolley to the second trolley. It is also preferable that to facilitate this movement the two trolleys should be held in a fixed relative position.

In a first aspect, the present invention provides a hospital trolley comprising a patient support member, and a framework for carrying the support member, the support member and the framework having cooperating guide means enabling the support member to be moved horizontally onto and off the framework.

The guide means may comprise at least one guide member on the upper surface of the framework and a co-operating locating member on the lower surface of the support member.

The guide member and locating member are preferably capable of horizontally interlocking and of moving over each other, such that the support member is capable of moving from the framework of a first trolley to that of a second trolley.

The guide members and locating members are preferably linear and parallel to each other. Guide means may be arranged close to each end or side of the support member or trolley framework and further guide means may be arranged between these. The guide means are arranged in the direction in which the patient is to be transferred so that when lateral transfer between trolleys is required the guide means are arranged across the width of the trolley framework and support member. Guide means may be provided on additional trolley frameworks to allow transfer of the support member from one trolley framework to another. Alternatively, the guide means may be arranged along the length of the trolley framework and support member thereby allowing longitudinal transfer between trolleys.

The guide member of each guide member may comprise a rod or tube of a uniform cross section. The locating member of each locating member may comprise a member capable of locating positively on the guide member and of moving along the full length of the associated guide member. The locating member is preferably an elongate member whose inner section is open and which corresponds with the outer section of the guide member. The inner section of the locating member or each locating member is open to allow it to pass any supporting member by which the guide member or each guide member is attached to the trolley framework. The inner circumference of the locating member or each locating member may correspond with more than one half the outer circumference of the associated guide member and may be so arranged that when the guide member and the locating member interact they cannot be separated except by a relative longitudinal movement. For example, the guide member may comprise a rod of circular cross section attached along its length by several supporting connections to the surface of the trolley framework. The locating member may then comprise sections of tube whose inner diameter corresponds with the outer diameter of the associated guide member. One segment of the tube, defining an angle of less than 180°, is cut away to allow it to pass the tube supports by which the tube is attached to the trolley framework.

In use the guide members may be attached to the upper surfaces of various trolley frameworks such that their relative position is identical on each trolley framework. The trolley frameworks may then be brought together and linked in such a position that the guide members on each trolley framework are aligned. The support member, carrying the patient, and to which are attached the locating members, may then be pulled from one trolley framework to the other. As it is transferred the locating members align with the guide members of the second trolley framework and they interact to guide the support member onto that trolley framework. Once located, the support member is unable to separate from the second trolley framework due to the positive interaction between the slide means and the locating means. Once the transfer is complete, the first trolley framework may be removed and used for a subsequent patient.

To facilitate the smooth movement of the or each locating member over the associated guide member, the inner surface of the or each locating member may have a coating or insert of a low-friction material. For example, inserts of polytetrafluoroethylene (PTFE) may be arranged within the locating member or each locating member such that their internal diameter corresponds with the outer diameter of the associated guide member. Alternatively, the outer surface of the guide member or each guide member may have a coating of a low-friction material.

In a second aspect the present invention provides means for releasably securing two trolley frameworks together to facilitate transfer of a patient from one trolley framework to the other. The securing means may comprise first and second plates which interlock, the first plate being attached to one trolley framework and the second plate to another trolley framework to which the first trolley framework is to be releasably secured.

The plates may comprise elongate flat plates preferably of generally rectangular configuration. The plates may have at one end a hinge, which in its simplest form may comprise a hole through which a peg may pass. A preferred form of hinge comprises an elongate slot, parallel to the long axis of the plate and positioned towards one corner and a long edge of the plate. A bracket, attached to a trolley framework, carries a peg, on which the plate hinges. The peg is positioned such that the plate can only rest with the long axis horizontal or vertical. The corner of the plate adjacent the slot is rounded so that the plate may move from a position where the long axis is horizontal to one where it is vertical. In the latter position the peg moves to the other end of the slot and the plate remains in an upright position.

The plate may thus be retained with its long axis vertical, when not in use, or with its long axis horizontal when positioned to interlock with the second plate. A similar hinge may also be provided on the second plate. When retained in the former position the plate prevents movement of the support on the slide tubes and locating tubes. It is only when the plates are lowered to the latter position for interlocking with a second trolley framework that the support is capable of disengaging from the trolley framework. This prevents the accidental movement of the support on the trolley.

Attached to one surface of the first plate, at a location spaced from the hinge, is a projection which extends at right angles to the said surface and through which there is a hole or slot. The projection is positioned such that the hole or slot is in a vertical position when the long axis of the plate is horizontal, as when the plate is positioned to be interlocked with the second plate. The projection may comprise a flat plate in which has been cut a hole or slot corresponding with a peg on the second plate. Alternatively, a ring may be welded to the side of the plate such that it projects in a perpendicular direction from the plane of the plate and the hole in the ring is vertical when the plate is positioned for interlocking. The hole in the centre of the ring is designed to locate with a peg on the interlocking plate.

The second plate may have a hinge similar to that described above which in preferred form comprises a slot through which a peg may pass. The end of the plate, distant from the hinge, is formed into a "peg" which faces in a downward direction when the plate is horizontal. The peg is formed of such dimensions that it passes through the slot or hole in the projection attached to the first plate. The peg may therefore comprise a rod, attached to the plate and bent to project in a downward direction. In a preferred form it is constructed by cutting a slot of metal from the end of the plate away from the hinge, in such a position that a peg is left at that end of the plate.

The peg in the second plate and the projection on the first plate are positioned such that the two plates may be brought into an interlocking situation, with the plates adjacent each other and the peg through the slot or hole. By suitable location of the first and second plates on respective trolleys, it is possible to align any two trolleys in a fixed position relative to each other, thereby allowing smooth and accurate transfer of a patient from one trolley to another, for example, by the guide means described above. The plates are easily released and may be left in a resting position.

Preferred embodiments of the invention will now be described by way of example with reference to the accompanying drawings, of which:

Figure 1:
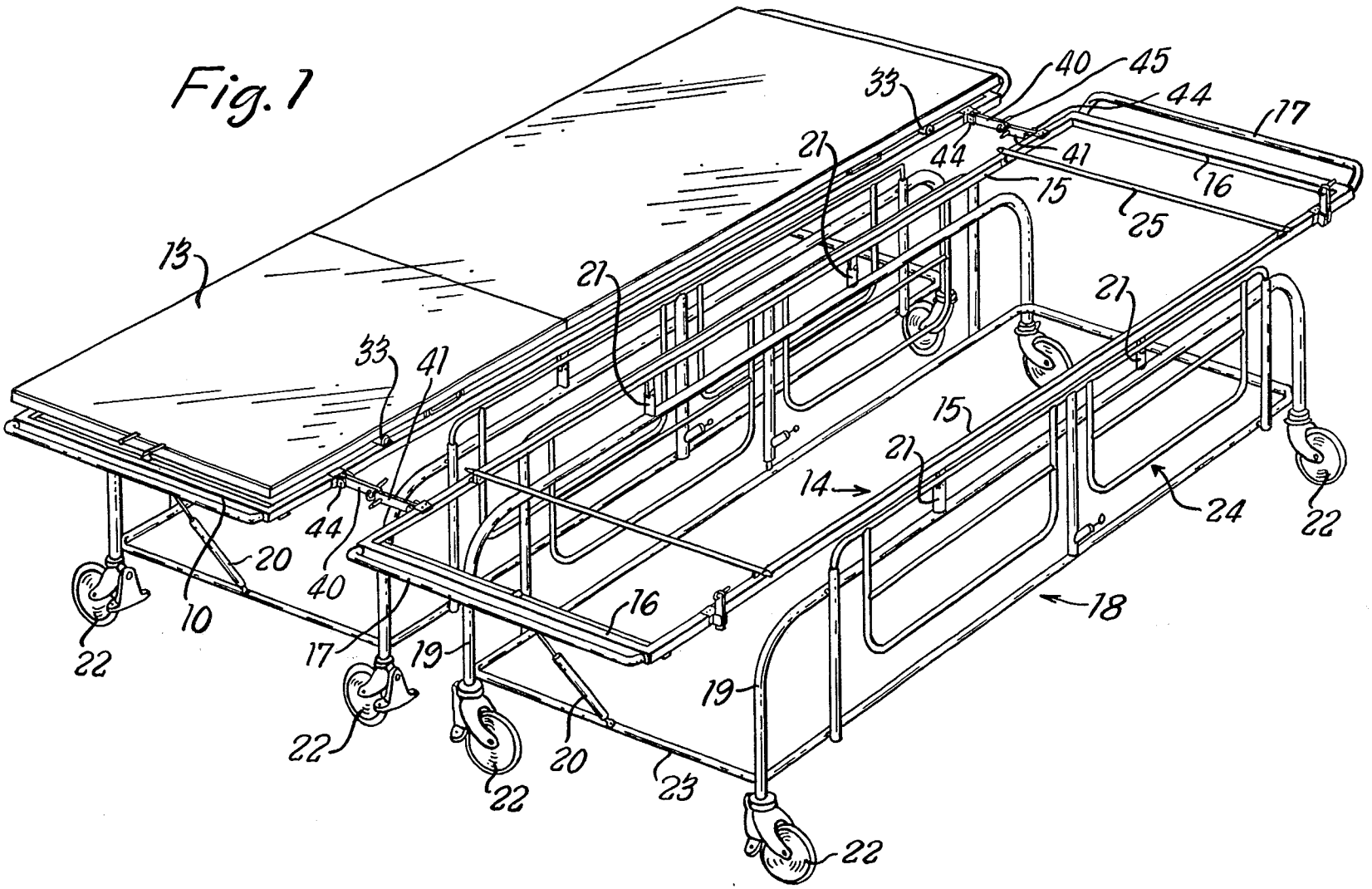
FIG. 1 is a perspective view of two trolley frameworks and a support member for transferring a patient from one trolley framework to the other.

FIG. 1 shows two trolley frameworks 10 and 11 which are substantially identical to one another. A patient support member 13 is situated on one of the frameworks and is adapted to be transferred laterally to the other framework.

Each trolley framework 10, 11 comprises a substantially rectangular metal frame 14 having two side frame members 15 and two end frame members 16. Connected to each end frame member 16 is a handle member 17 by means of which the trolley may be wheeled over the ground. The rectangular frame 14 is supported on a lower framework indicated generally at 18. The lower framework 18 comprises two inverted substantially U-shaped members 19 to the ends of which the side frame members 15 are connected by struts 21. At the free end of each limb of each U-shaped member 19 is a wheel 22 by means of which the trolley is moved. A second generally rectangular framework 23 is attached to the limbs of the U-shaped member 19 at a position adjacent the wheels 22.

A gas spring 20 is provided between the framework 23 and one end frame member 16. This enables one end of the frame 14 to be tilted about the adjacent pair of struts 21 and so lift the head or feet of a patient on the trolley.

Each trolley framework is provided with side members 24 which can be raised, if necessary, so as to prevent a patient falling sideways off the trolley.

Figure 3:
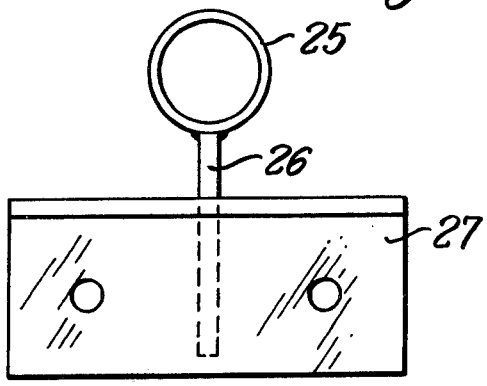
FIG. 3 is an end view of a guide member forming part of the guide means.
Figure 4:
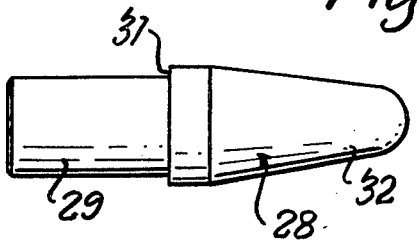
FIG. 4 is a side elevation of a plug forming part of the guide member of FIG. 3.

Extending transversely of each frame 14 are two guide members 25 which are shown in more detail in FIGS. 3 and 4. The guide members 25 are in the form of hollow metal rods and are welded adjacent each end to a flat support plate 26 which is secured to a bracket 27. The brackets 27 are secured to the inner surface of the side frame members 15. The open ends of the guide members 25 are closed by a plug 28 of polytetrafluoroethylene. The plug 28 has a stem 29 which enters the guide member 25 until the end of the member 25 abuts a shoulder 31 on the plug. The plug 28 has a conical head 32 for a purpose to be described hereinafter.

Figure 2:
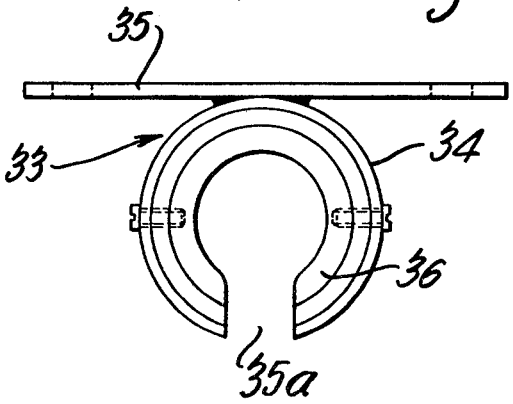
FIG. 2 is an end view of a locating member forming part of guide means for use in transferring a support member from one framework to the other.

The support member 13 has locating means on its lower surface comprising two open tubes 33 which are shown in detail in FIG. 2. Each tube 33 comprises an outer steel tube 34 welded to a bracket 35 which is attached to the underside of the support member. A longitudinal slot **35*a* is formed in the tube opposite the bracket 35. Situated within the tube 34 is a part-cylindrical liner 36 of polytetrafluoroethylene and which is secured to the steel tube 34 by means of screws spaced along the steel tube 34 and passing into the liner 36. The outer ends of the polytetrafluoroethylene liner 36** are chamfered.

The tubes 33 are positioned to permit the support member 13 to be moved laterally until the heads 32 of the plugs 28 at the ends of the guide members 25 engage and locate the chamfer at the ends of the tube 33. On continued lateral movement of the support member 13 the tubes 33 slide over the guide members 25 until the support member is completely transferred to the new trolley framework when the old trolley framework may be removed and reused.

It will be appreciated that the inner diameter of the liners 36 correspond to the outer diameters of the guide members 25 and that the slots 35 in the tubes 33 permit the tubes to pass the points at which the guide members are secured to the trolley.

It is desirable, although not essential, that the two trolley frameworks should be connected together while the transfer of the support member takes place. To this end one side frame member of each trolley is provided with two pivotable plates 40 while the other side frame member is provided with pivotable plates 41. The arrangement is such that a plate 40 is arranged to engage a plate 41. Each plate 40, 41 is substantially rectangular in shape and is provided with a rounded corner 42. Adjacent this corner is a slot 43 which extends parallel with the longer sides of the plate. Pairs of brackets 44 (see FIG. 1) extend outwardly from the side frame members 15 and a pin (not shown) passes from one bracket 44, through the slot 43 in the respective plate, and to the other bracket 44 of the pair. This arrangement enables the plates 40, 41 to pivot from the horizontal position shown in FIG. 1 upwardly to a vertical position. It will be appreciated that when the plates are vertical the support member cannot be moved onto a second trolley framework. Thus accidental movement of the support member is prevented.

Figure 5:
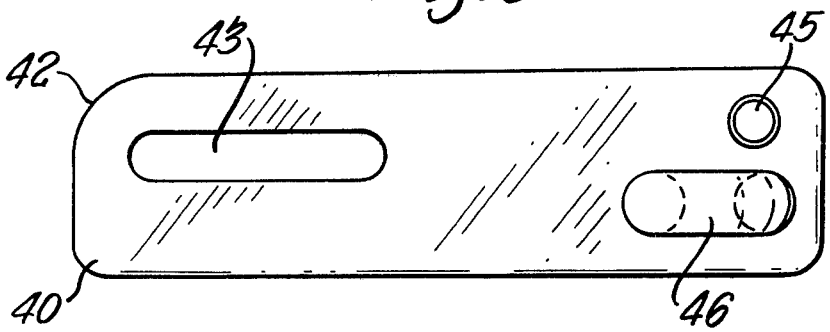
FIG. 5 is a side elevation of a plate used to connect two trolley framework together.
Figure 6:
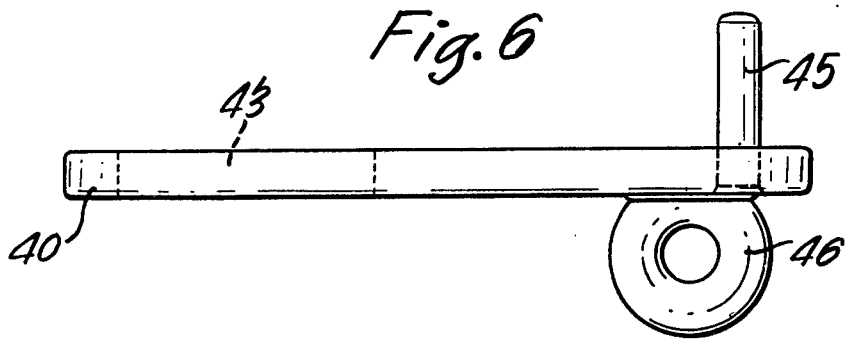
FIG. 6 is a plan view of the plate of FIG. 5.

Each plate 40, 41 is provided with a handle 45 by means of which the plates can be manipulated. As can be seen from FIGS. 5 and 6 the plates 40 have ring-members 46 mounted on one side while the plates 41 have downwardly extending pins which pass into the ring-members 46 and retain the two trolleys in side-by-side relationship.

Figure 7:
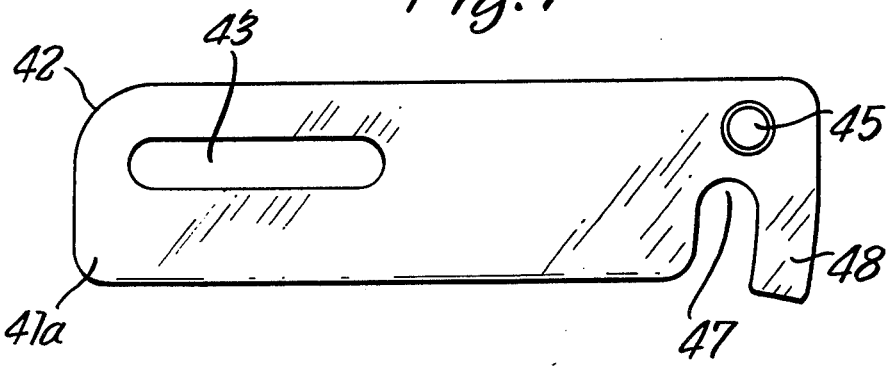
FIG. 7 is a side elevation of a modified plate.

The plates 41 may be modified, for example as shown in FIG. 7. Here the plate 41*a* is provided with an arcuate slot 47 which forms an integral pin 48 which can engage the hole in the ring member 46.

Various modifications may be made to the embodiments described without departing from the scope of the invention claimed. For example, although two guide members and locating members are shown, it is possible to use three or even more. The guide and locating members are shown as having circular cross sections but, of course, any cross-section can be used provided that the locating member slides over the guide member. The guide members could, alternatively, be positioned on the support member while the locating members are situated on the trolley frameworks. Means may be provided on the framework for ensuring that the frame 14 is perfectly horizontal when transfer between two trolleys takes place.

What is claimed is:

1. A hospital trolley comprising:

a patient support member;

a framework member adapted to carry said support member, a guide rod attached to one of said members;

a hollow locating tube attached to the other of said members and adapted to cooperatively engage with said guide rod; and a liner of low friction material adapted to be interposed between the outer surface of said guide rod and the inner surface of said locating tube when said guide rod is inserted into said locating tube.

2. A hospital trolley as in claim 1 in which the framework includes means for securing it to the framework of a similar trolley so as to align the guide means on the framework of the first trolley with the guide means on the framework of the second trolley.

3. A hospital trolley as claimed in claim 2 in which the securing means comprises at least one plate adapted to engage a plate on a similar trolley.

4. A hospital trolley as in claim 3 in which the plate or each plate is partially mounted on the framework and carries a ring for receiving a pin on a plate pivotally mounted on the framework of a similar trolley.

5. A trolley as in claim 1 wherein said liner comprises a coating of low friction material on the outer surface of said guide rod.

6. A trolley as in claim 1 wherein said liner comprises a coating of low friction material on the inside surface of said locating tube.

7. A trolley as in claim 1 wherein said liner is a tubular insert of low friction material inserted into said locating tube and adapted to slidably receive said guide rod.

8. A trolley as in claim 7 wherein said hollow tube and said liner are split axially to form a slot along the length thereof.

9. A trolley as in claim 7 wherein said liner is of polytetrafluoroethylene.

* * * * *